US008343254B2

(12) United States Patent
Lee et al.

(10) Patent No.: US 8,343,254 B2
(45) Date of Patent: Jan. 1, 2013

(54) METHOD OF PREPARING COMPOSITE NICKEL PARTICLES

(75) Inventors: Young Il Lee, Kyungki-do (KR); Jae Woo Jung, Kyungki-do (KR); In Keun Shim, Seoul (KR)

(73) Assignee: Samsung Electro-Mechanics Co., Ltd. (KR)

( * ) Notice: Subject to any disclaimer, the term of this patent is extended or adjusted under 35 U.S.C. 154(b) by 564 days.

(21) Appl. No.: 12/603,080

(22) Filed: Oct. 21, 2009

(65) Prior Publication Data

US 2010/0101370 A1 Apr. 29, 2010

Related U.S. Application Data

(62) Division of application No. 11/590,809, filed on Nov. 1, 2006, now abandoned.

(30) Foreign Application Priority Data

Nov. 1, 2005 (KR) ..... 10-2005-0103742

(51) Int. Cl.
*B22F 9/24* (2006.01)
*B82Y 40/00* (2006.01)

(52) U.S. Cl. ..... 75/365; 75/369; 977/890; 977/896

(58) Field of Classification Search ..... 75/343, 75/351, 362, 370, 371; 148/513; 428/404, 428/405

See application file for complete search history.

(56) References Cited

U.S. PATENT DOCUMENTS

| | | | | |
|---|---|---|---|---|
| 5,622,896 | A | 4/1997 | Knotter et al. | |
| 6,007,743 | A | 12/1999 | Asada et al. | |
| 6,503,560 | B2 | 1/2003 | Toshima et al. | |
| 6,548,264 | B1 * | 4/2003 | Tan et al. | 435/7.21 |
| 2002/0055002 | A1 | 5/2002 | Toshima et al. | |
| 2005/0121656 | A1 | 6/2005 | Choi et al. | |
| 2007/0246245 | A1 * | 10/2007 | Ahn et al. | 174/126.2 |

FOREIGN PATENT DOCUMENTS

| | | | |
|---|---|---|---|
| EP | 0 992 308 | A2 | 9/1999 |
| JP | 11-343501 | A | 12/1999 |
| JP | 2004-218030 | | 8/2004 |
| JP | 2005-163142 | | 6/2005 |
| JP | 2005-163142 | A * | 6/2005 |
| JP | 2005-163152 | A | 6/2005 |
| KR | 1999-088656 | A | 12/1999 |

OTHER PUBLICATIONS

W. Fu et al. Preparation and characteristics of core-shell structure nickel/silica nanoparticles, Colloids and Surfaces A: Physiochem. Eng. Aspects, vol. 262, (2005), pp. 71-75.* E.R. Leite et al. Development of Metal-SiO2 Nanocomposites in a Single-Step Process by the Polymerization Complex Method, Chem. Mater., vol. 14, (2002), pp. 3722-3729.*

Japanese Office Action issued in Japanese Patent Application No. 2006-297859, dated Sep. 29, 2009.

Korean Office Action issued in corresponding Korean Patent Application No. 10-2005-0103742 mailed on Apr. 19, 2007.

Translation of JP 2005-163142, published Jun. 6, 2005.

* cited by examiner

*Primary Examiner* — George Wyszomierski

(74) *Attorney, Agent, or Firm* — McDermott Will & Emery LLP

(57) ABSTRACT

Composite Ni particles each having a silica coat is improved in oxidation resistance and heat shrink characteristics. A method of preparing composite Ni particles by using an organic Ni composite includes steps of: stirring and heating a nickel salt solution and a raw material of silica coat at a temperature ranging 25° C. to 80° C. for 0.5 hours to 2 hours; filtering, cleaning and drying a resultant product into an organic nickel composite; and thermally treating the organic nickel composite at a temperature ranging from 200° C. to 500° C. for 0.5 hours to 4 hours. The resultant composite Ni particles have excellent oxidation resistance and heat shrink characteristics.

5 Claims, 5 Drawing Sheets

(a) (b)

(a) (b)

METHOD OF PREPARING COMPOSITE NICKEL PARTICLES

CLAIM OF PRIORITY

This application is a Divisional of U.S. patent application Ser. No. 11/590,809, filed on Nov. 1, 2006, now abandoned, and claims the benefit of Korean Patent Application No. 2005-103742 filed on Nov. 1, 2005, in the Korean Intellectual Property Office, the entire contents of each of which are hereby incorporated by reference.

BACKGROUND OF THE INVENTION

1. Field of the Invention

The present invention relates to composite nickel particles each having a silica coat formed on a nickel (Ni) core, and more particularly, composite Ni particles each having a silica coat improved in oxidation resistance and heat shrink characteristics and a method of preparing composite Ni particles by using an organic Ni composite.

2. Description of the Related Art

A multilayer ceramic capacitor (MLCC) is fabricated by alternatingly laminating dielectric material layers and internal electrode layers one atop another, bonding the laminated structure of layers together by compression, and densifying the laminated structure by hot firing. In the MLCC, the internal electrodes are fabricated generally by forming metal paste from fine metal powder, printing the metal powder on ceramic dielectric sheets, stacking a plurality of the printed dielectric sheets one atop another, heating and compressing the stack of the printed dielectric sheets, and curing the resultant structure in a reducing atmosphere. The internal electrodes have been made conventionally by noble metals such as platinum (Pt) and palladium (Pd). Recently, however, technologies of using base metals such as Ni have been researched and developed.

In fabrication of an MLCC, firing temperature is different according to the composition of a ceramic dielectric material but typically from 1000° C. to 1400° C. for barium titanate ($BaTiO_3$) based dielectric material. However, Ni metal powder when used for the internal electrode material is subject to rapid heat shrink at a temperature from 400° C. to 500° C. which is much lower than the firing temperature. The Ni metal powder used as the internal electrode material is apt to create defects such as delamination and cracks in the firing due to heat shrink difference between ceramic dielectric material and Ni metal powder.

Accordingly, in order to prevent delamination or cracks in the firing, it is preferred to shift rapid heat shrink starting temperature of the Ni metal powder toward a high temperature range to lower heat shrinkage so that the Ni metal powder can have a heat shrink behavior as similar as possible to that of the ceramic dielectric material.

In addition, in a case where a ceramic dielectric material is fired in contact with a metal, the metal is generally oxidized and a resultant oxide has a diffusion coefficient higher than that of the ceramic dielectric material. Thus, at grain boundaries, diffusion easily takes place from a metal oxide of a higher diffusion coefficient into ceramics of a lower diffusion coefficient. Accordingly, in a case where typical paste of Ni metal powder is used, fine particles of Ni metal are oxidized and resultant Ni oxides are diffused into ceramic dielectric layers. As a result, the internal electrodes are destroyed partially or internally defected and ferrites formed damage dielectric characteristics of a portion of the ceramic dielectric material. Accordingly, in order to fabricate a miniature and slim MLCC having ceramic dielectric layers and internal electrode layers without having to damage dielectric characteristics and electric properties, it is preferred for the Ni powder of the internal electrodes to have excellent oxidation resistance.

To reduce heat shrinkage of the Ni metal powder and shift shrink and oxidation starting temperatures to a higher temperature range, several conventional approaches have been proposed, in which oxygen content of the Ni powder is reduced or an oxide coat was formed on the surface of the Ni powder.

Examples of oxides for coating the Ni powder may include single oxides such as $TiO_2$, $SiO_2$, MgO and $Al_2O_3$ and composite oxides such as $BaTiO_3$, $SrTiO_3$, $Ba_{1-x}Ca_xTiO_3$, $BaTi_{1-x}Zr_xO_3$. Methods of coating the Ni powder may include a spray pyrolysis method (U.S. Pat. No. 6,007,743), a dry mechanical-chemical mixing method (Japanese Laid-Open Patent Application No. 1999-343501) and the like.

In the spray pyrolysis method, it is possible to fabricate Ni powder containing a composite oxide by spraying a solution containing a thermally decomposable compound and a Ni precursor into droplets and thermally decomposing the droplets. However, in the spray pyrolysis method, oxides are formed not only on the surfaces of Ni particles but also inside the Ni particles. Then, the oxides may reside as impurities after the formation of electrodes. On the other hand, in case of oxide-coated Ni powder prepared by the dry mechanical-chemical mixing method, oxide coats do not strongly adhere to the surfaces of Ni particles and thus may be separated from the Ni particles in manufacturing of paste. This makes it difficult to sufficiently prevent heat shrink of the Ni powder in firing and weak oxidation resistance may permit oxidized Ni powder to diffuse into dielectric layers.

In addition, as disclosed Japanese Laid-Open Patent Application No. 2005-163142, a silicon compound and —OH group on metal forms a silica coat on metal by condensation. Korean Patent Application Publication No. 1999-88656 discloses a method of directly attaching to metal particles by adjusting pH. However, while Japanese Laid-Open Patent Application No. 2005-163142 and Korean Patent Application Publication No. 1999-88656 relate to oxide coating of for example silica on the surface of previously prepared Ni metal particles, the present invention pertains to silica coated on the surface of Ni particles simultaneously with the formation of the Ni particles. That is, in the present invention, metal particles and silica coats are formed in one-step process, which is basically different from the two prior arts.

While Japanese Laid-Open Patent Application No. 2005-163142 discloses silica coating by using a silane coupling agent, coordinate bond by using a silane coupling agent of the invention as a raw material of a silica coat is not disclosed therein. Furthermore, since examples are limited generally to copper (Cu), the thickness of the silica coat is not easily controlled and secondary particles of silica are produced in case of silica coating by using TEOS.

Korean Patent Application Publication No. 1999-88656 pertains to a method of coating oxide on metal surface through a typical aqueous reaction, which is basically different from a method of the present invention in which a heated silane coupling agent forms a silica coat by condensation. In addition, Korean Patent Application Publication No. 1999-88656 does not use the silane coupling agent as a raw material of the coat. In this prior art, an oxide layer of fine crystal can be rarely formed and weak bonding force between the coat and the Ni particles restrict oxidation resistance and shrink characteristics.

Accordingly, there are demands for a method of preparing a composite Ni powder having a silica coat which is free from the above-mentioned technical problems, has excellent oxidation resistance and heat shrink characteristics similar to those of a ceramic dielectric material, thereby preventing defects such as delamination and cracks, and thus can be used an internal electrode material in fabrication of an MLCC.

SUMMARY OF THE INVENTION

The present invention has been made to solve the foregoing problems of the prior art and therefore an object of certain embodiments of the present invention is to provide a composite Ni powder having a silica coat which shows excellent oxidation resistance in firing and heat shrink characteristics similar to those of a ceramic dielectric material, thereby preventing defects such as delamination and cracks.

Another object of the invention is to provide a composite Ni powder having a silica coat of excellent oxidation resistance to prevent the metal powder from diffusing into a dielectric material layer.

Further another object of the invention is to provide a method of preparing a composite Ni powder having a silica coat.

According to an aspect of the invention for realizing the object, the invention provides a composite nickel particle comprising a silica coat formed on a nickel nano particle by condensation reaction of a raw material of the silica coat.

According to another aspect of the invention for realizing the object, the invention provides method of preparing nickel composite particles each having a nickel nano particle and a silica coat on the nickel nano particle. The method includes steps of: stirring and heating a nickel salt solution and a raw material of silica coat at a temperature ranging 25° C. to 80° C. for 0.5 hours to 2 hours; filtering, cleaning and drying a resultant product into an organic nickel composite; and thermally treating the organic nickel composite at a temperature ranging from 200° C. to 500° C. for 0.5 hours to 4 hours.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Figure 1:
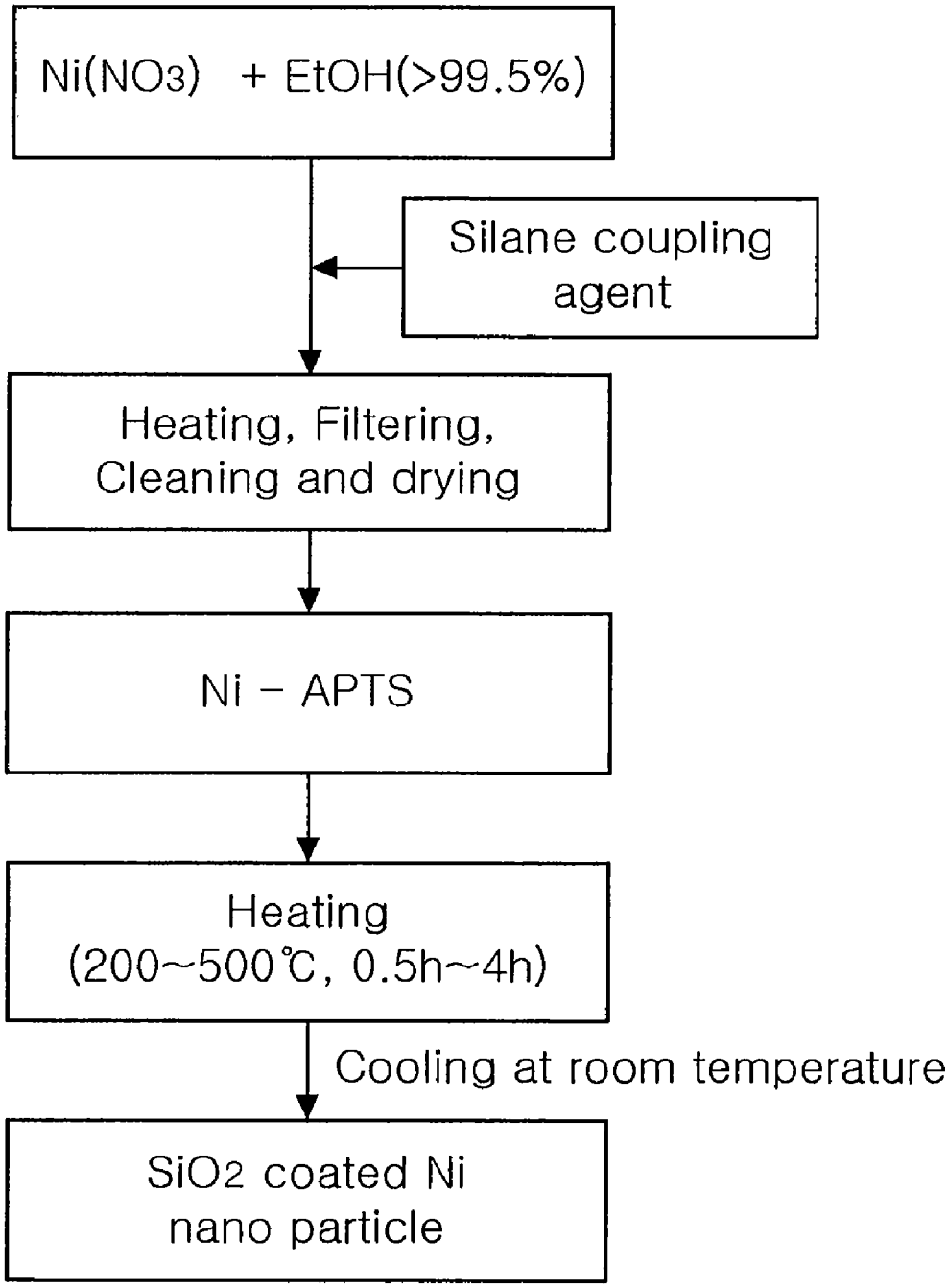
FIG. 1 is process flowchart illustrating a method of preparing composite Ni particles according to an embodiment of the invention.

The present invention will now be described more fully hereinafter with reference to the accompanying drawings, in which preferred embodiments of the invention are shown.

A composite Ni particle of the invention contains a Ni nano particle and a silica coat surrounding the surface of the Ni nano particle. The silica coat surrounding the Ni particle surface when sintered produces excellent oxidation resistant characteristics and heat shrink characteristics similar to those of a ceramic dielectric substance. The composite Ni particle is free of defects such as delamination and cracks while maintaining conductivity and electric properties. Accordingly, composite Ni particles of the invention are suitable as a material for producing internal electrodes of a multilayer ceramic capacitor, thereby enabling fabrication of a compact multilayer ceramic capacitor.

A composite Ni particle of the invention has a silica coat formed on a Ni nano particle, by condensation reaction of a raw material of the silica coat. That is, the composite Ni particle of the invention has the silica coat substantially formed on the surface of the Ni nano particle. This means that the silica coat is formed on the surface of the Ni nano particle only, and even though silica diffuses into the Ni nano particle, the amount of silica diffusion is extremely small not to have an effect on required physical properties such as oxidation resistance and improved heat shrink. Preferably, silica exists on the surface of the Ni nano particle but absent inside the Ni nano particle. Since the silica coat is formed on the surface of the Ni nano particle only and any oxide does not exist inside metal, there is no worry of oxides residing as impurities after formation of electrodes. Furthermore, oxidation of the Ni metal particle prevents Ni oxide from diffusing into a ceramic dielectric layer and thereby any loss of internal electrodes.

The silica coat of the composite Ni particle has a thickness ranging from 1 nm to 100 nm, and the composite Ni particle has an average thickness ranging from 30 nm to 400 nm. In the composite Ni particle, the thickness of the silica coat can be adjusted by controlling heat treatment time (condensation reaction time) and the type of the raw material of the silica coat. That is, the thickness of the silica coat can be varied according to the number of amino groups and the Ni reducibility of the silica raw material. The thickness of the silica coat is in the range from 1 nm to 100 nm, and preferably, from 1 nm to 50 nm. At a coat thickness less than 1 nm, the coating layer or coat is too thin to control plastic shrink or oxidation. When fabricated according to the invention, a composite Ni particle has a maximum silica coat thickness of about 100 nm. The composite Ni particle with the silica coat thickness of 100 nm shows excellent oxidation resistance and heat shrink characteristics without having an effect on electric characteristics.

A Ni particle, a core of the composite Ni particle, has an average diameter of about 30 nm to 300 nm, and the composite Ni particle having the silica coat has an average diameter of 30 nm to 400 nm when produced by the invention. The composite Ni particle of this size has desired oxidation resistance and heat shrink characteristics without having an adverse effect on electric characteristics. Accordingly, the composite Ni particle of the invention can be made with a suitable particle size according to physical properties of internal electrodes, which are demanded by various applications.

In the composite Ni particle of the invention like this, a Ni salt solution and a silica coat raw material are heated into an organic Ni composite, which is thermally treated to produce a Ni nano particle core and a silica coat surrounding the Ni nano particle core in one-step process.

The silica coat raw material is a silane coupling agent containing a donor for affording electrons to Ni ions and a silane group capable of forming silica by condensation. Examples of the silane coupling agent may include but not limited to 3-aminopropyl trimethoxysilane (APTS), 3-(2-aminoethylamino)propyl trimethoxysilane and 3-[2-(2-aminoethylamino)ethylamino]propyl-trimethoxysilane.

According to another aspect of the invention, the invention provides a method of preparing Ni composite particles each composed of a Ni nano particle and a silica coat on the Ni nano particle. The preparing method is schematically illustrated in FIG. 1, in which Ni nitrate is used as Ni salt. In the method of preparing composite Ni particles according to the invention, an organic Ni complex is obtained and then thermally treated to produce a metal nano particle core and a silica coat surrounding the core in one-step process. In detail, the process includes steps of: stirring and heating a Ni salt solution and a raw material of a silica coat; filtering, cleaning and drying a resultant product into an organic Ni composite; and thermally treating the organic Ni composite.

First, the Ni salt is solved into a solvent to produce a Ni salt solution, a raw material of the silica coat is added to the Ni salt solution, and a resultant product is stirred and heated.

Examples of the solvent may include ethanol absolute, methanol absolute, isopropanol absolute and so on.

The Ni salt may employ any Ni compounds that can be solved into aqueous solvents and produce Ni metal via reduction. Example of the Ni compounds may include but not limited to Ni nitrides (e.g., $Ni(NO_3)_2$) chlorides (e.g., $NiCl_2$), sulfides (e.g., $NiSO_4$) and Ni acetates (e.g., $(CH_3COO)_2Ni$) that can be easily solved into the aqueous solvents.

The amount of the Ni salt added into the solvent to produce the Ni salt solution is for example of 0.1 mole to 3 moles but not specifically limited thereto. By adjusting the amount of the silica raw material described later according to the content of the Ni salt, it is possible to produce desired composite Ni particles. While the Ni salt is solvable into the solvent at room temperature, temperature growth can made up to about 50° C. so that the Ni salt can be solved more efficiently.

Then, the raw material of the silica coat is added into the Ni salt solution. The amount of the raw material added is preferably 0.3 moles to 2 moles per 1 mole of the Ni salt. At a content of the raw material less than 0.3 moles, Ni particles are not sufficiently reduced. At a content of the raw material exceeding 2 moles, Ni particles do not form a global shape and thus cohesion stability of the particles is lowered.

The raw material to be used for forming a silica coat on the surface of each Ni metal particle may be a silane coupling agent composed of a donor for affording electrons to nickel ions and a silane group capable of forming silica by condensation. Examples of the silane coupling agent may include but not limited to 3-aminopropyl trimethoxysilane (APTS), 3-(2-aminoethylamino)propyl trimethoxysilane and 3-[2-(2-aminoethylamino)ethylamino]propyl-trimethoxysilane.

Figure 2:
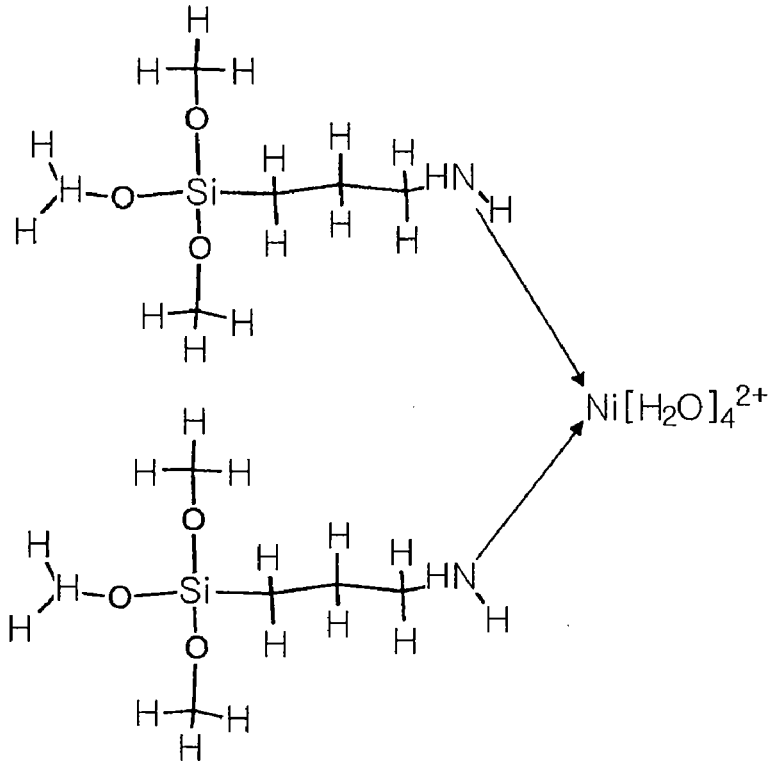
FIG. 2 is a diagram illustrating coordinate bond between a Ni ion and nitrogen atoms according to a method of the invention.

As the Ni salt solution and the raw material of the silica coat are stirred and heated, lone pair electrons of nitrogen atoms of the amino group of the silane coupling agent act as donors for affording electrons to Ni ions of core metal so that the silane coupling agent performs coordinate bond with Ni atoms as shown in FIG. 2, thereby forming a composite. In the meantime, Ni salt solved into the solvent is dissociated into Ni cations and anions, and lone pair electrons of nitrogen atoms reduce the Ni cations into Ni atoms. FIG. 2 is a diagram illustrating the silane coupling agent such as APTS bonded with a Ni atom, through two coordinate bonds.

Here, heating is carried out for 0.5 hour to 2 hours at a temperature ranging from 25° C. to 80° C. Preferably, heating is performed while being stirred. At a temperature less than 25° C., an organic Ni composite is formed slow and thus the yield of composite Ni particles is low. In view of the boiling point of the alcoholic solvent, the heating temperature is preferably 80° C. or less. Reaction time is preferably for 0.5 hour to 2 hours in terms of the efficiency of reaction. At a reaction time less than 0.5 hour, the organic Ni composite is not formed sufficiently. At a reaction time of about 2 hours, the raw material of the silica coat performs sufficient coordinate bond with metal.

After the heating, the organic Ni composite is reduced by filtering and then obtained by cleaning and drying. The filtering, cleaning and drying are not specifically limited but can be carried out by any methods well known in the art. For example, the filtering can be carried out by using a filter, and the cleaning can be carried out by using ethanol absolute, methanol absolute and isopropanol absolute and so on. The drying can be carried out in an oven.

Figure 3:
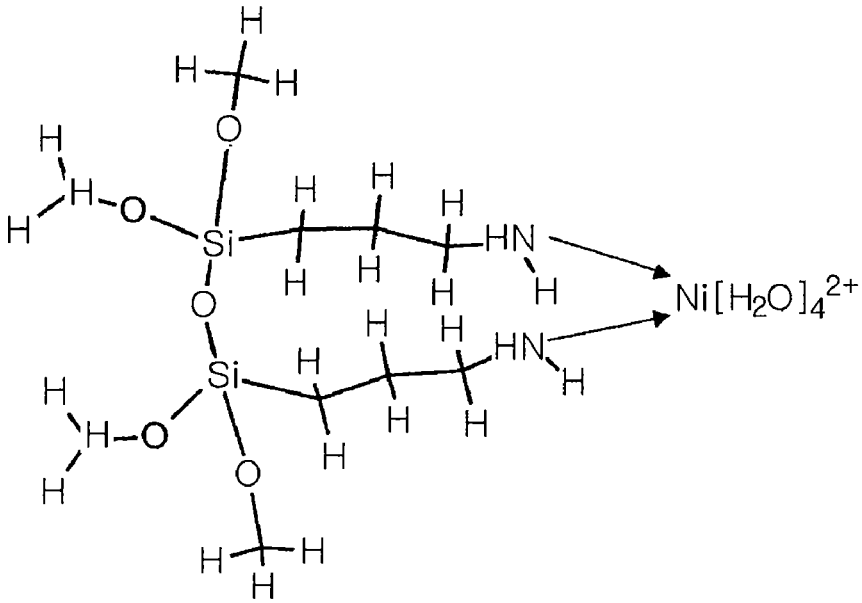
FIG. 3 is a diagram illustrating condensed state of a silane coupling agent coordinate bonded to a Ni ion according to a method of the invention.
Figure 4:
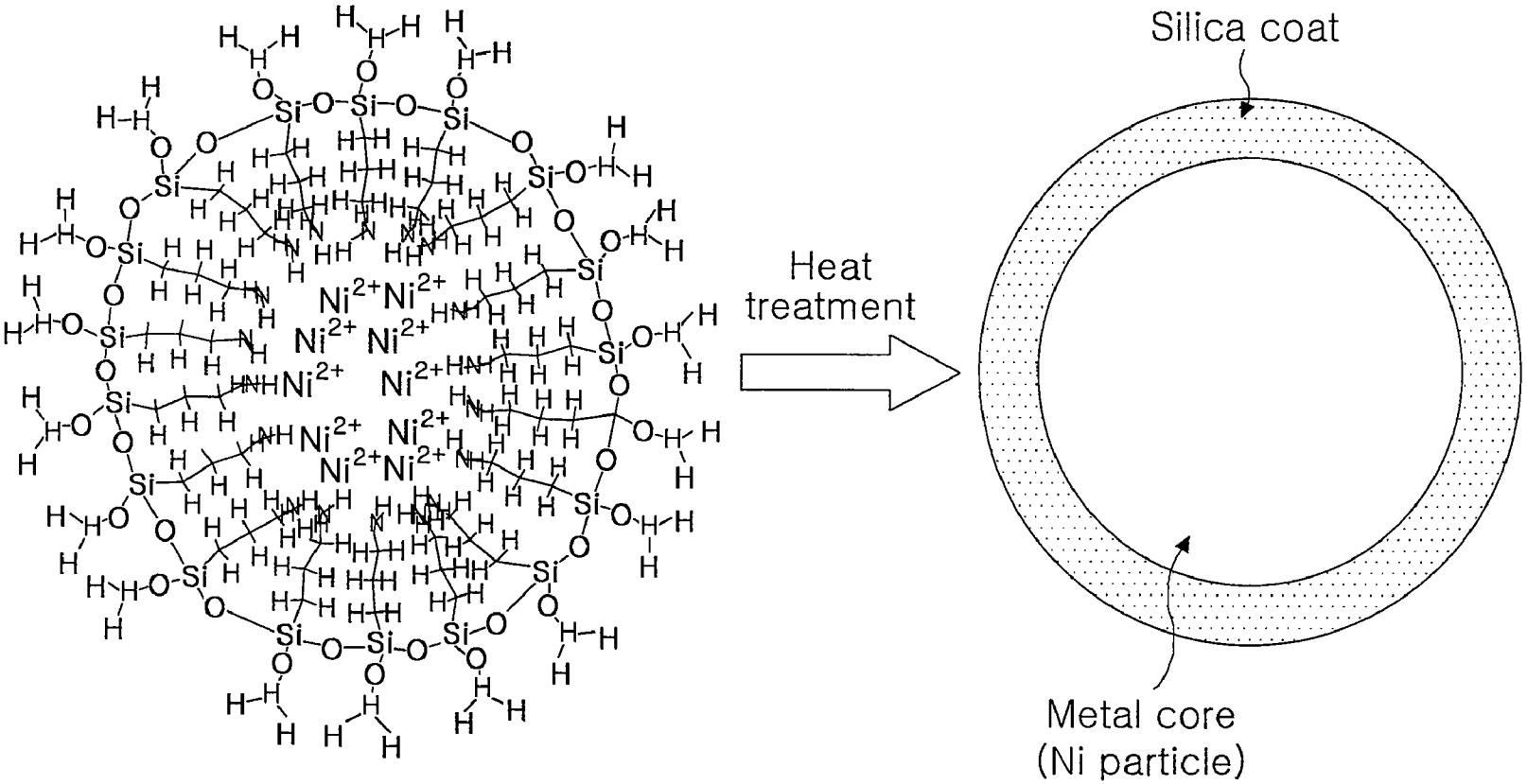
FIG. 4 is a diagram illustrating a silica coat formed surrounding a Ni particle by thermal treatment according to a method of the invention.

The organic Ni composite obtained above is thermally treated so that the silane coupling agent bonded to Ni metal via coordinate bond forms a silica coat on Ni particles by condensation. For example, in case of APTS, methoxy group performs condensation as shown in FIG. 3. With the heat treatment proceeded, the condensation is further carried out so that the silica coat is formed on the surface of Ni nano particles. In case of APTS used as the silane coupling agent, the raw material of the silica coat performs condensation forming the silica coat on a metal core as shown in FIG. 4.

Although not limited to followings, the thermal treatment is carried out preferably at a temperature for example of 200° C. to 500° C., and more preferably, 300° C. to 450° C. in view of the forming rate of the coat and the risk of the quality change of the reacting materials. That is, since a condensation reaction may not take place between the silica coat raw material at a temperature less than 200° C. and reaction efficiency does not rise even at a temperature exceeding 500° C., the reaction is preferably performed at the temperature of 200° C. to 500° C.

Thermal treatment time is performed for a time period sufficient for the silica coat to be formed sufficiently but not specifically limited thereto. In addition, the thickness of the coat can be controlled by adjusting the thermal treatment time, which can be set to be 0.5 hour, 1 to several hours and, preferably, up to 4 hours in view of thickness control. At a thermal treatment time less than 0.5 hour, a silica coat is not formed sufficiently on Ni nano particles. A sufficiently silica coat of about 100 nm is formed through thermal treatment of about 4 hours, and thus a treatment time exceeding 4 hours is inefficient.

The thermal treatment can be carried out in nitrogen, hydrogen or atmospheric ambient. In addition, the thermal treatment can be performed in a vacuum oven, an electric furnace and a drier. Although the thermal treatment can be carried out in an opened or closed condition, it is preferably carried out in a closed vessel in view of reaction efficiency. That is, the thermal treatment can be performed in an opened or closed vessel. After the thermal treatment, a result product is cooled down to a room temperature, thereby producing composite Ni particles each having the silica coat.

The composite Ni particles prepared as above have a particle size of 30 nm to 400 nm and the silica coat has a thickness of about 1 nm to 100 nm. The thickness of the coat can be varied according to the concentration and type of the silica raw material (the number of amino groups and the Ni reducibility of the silica raw material) and the thermal treatment time.

When the composite Ni particles is produced according to the method of the invention, each Ni nano particle acting as a core and a silica coat surrounding the same are formed simultaneously by one-step process.

Pure Ni powder increases its own weight by oxidation at a temperature of 300° C. or more. However, the composite Ni particles of the invention or prepared according to the method of the invention start oxidation at a temperature higher for about 100° C. than a typical oxidation starting temperature. This shows that the silica coat improves oxidation resistant characteristics.

In addition, the composite Ni particles of the invention or prepared according to the method of the invention show a remarkably improved heat shrinkage in which heat shrink starts at a temperature of 700° C. or more. This as a result reduces the difference in shrinkage between internal electrodes and ceramic dielectric material in fabrication of an MLCC, thereby preventing defects such as delamination and cracks. Accordingly, the composite Ni particles of the invention are very suitable for internal electrode material of the MLCC.

The invention will now be described in detail with reference to following Examples.

Example 1

1 mole of nickel nitrate ($Ni(NO_3)_2$), by a volume of 500 ml, was added and solved into ethanol absolute, and 3-aminopropyl trimethoxysilane (APTS) was added thereinto. Then, a resultant solution was stirred 1000 rpm at 25° C. for 10 mins. The temperature was raised to 75° C., which was maintained for 1 hour. After cooled down to a room temperature, the resultant solution was filtered by a 5 μm filter, cleaned three times with 100 ml ethanol absolute, and dried in a 50° C. oven for 4 hours, thereby producing an organic Ni composite.

Figure 5:
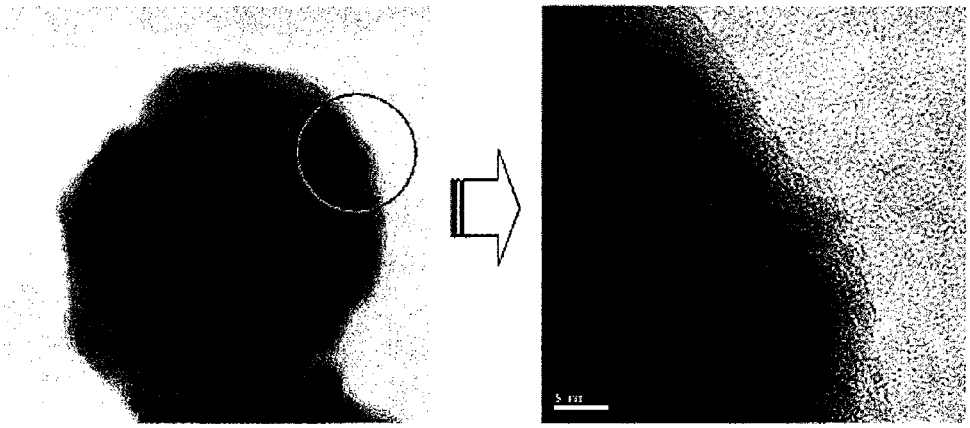
FIG. 5 illustrates a composite Ni particle prepared according to first Example, in which (a) is a TEM picture of the composite Ni particle, and (b) is a partially enlarged TEM picture of the composite Ni particle.

10 g of the organic Ni composite was loaded into a pyrex tube and sealed in $N_2$ or $H_2$ ambient. The sealed tube was loaded into an electric furnace and thermally treated at 450° C. for 1 hour to prepare silica-coated Ni composite particles. A result of TEM analysis on a prepared Ni composite particle is shown in FIGS. 5(*a*) (magnification of 200,000×) and 5(*b*) (magnification of 300,000×). As shown in FIGS. 5(*a*) and 5(*b*), a composite Ni particle was observed with silica uniformly coated on a Ni core. The Ni core of the Ni composite particle had a diameter of 80 nm to 120 nm and the silica coat had a thickness of about 4 nm to 5 nm.

Example 2

1 mole of nickel nitrate ($Ni(NO_3)_2$), by a volume of 500 ml, was added and solved into ethanol absolute, and 3-(2-aminoethylamino)propyl trimethoxysilane was added thereinto. Then, a resultant solution was stirred 1000 rpm at 25° C. for 10 mins. The temperature was raised to 75° C., which was maintained for 1 hour. After cooled down to a room temperature, the resultant solution was filtered by a 5 μm filter, cleaned three times with 100 ml ethanol absolute, and dried in a 50° C. oven for 4 hours, thereby producing an organic Ni composite.

Figure 6:
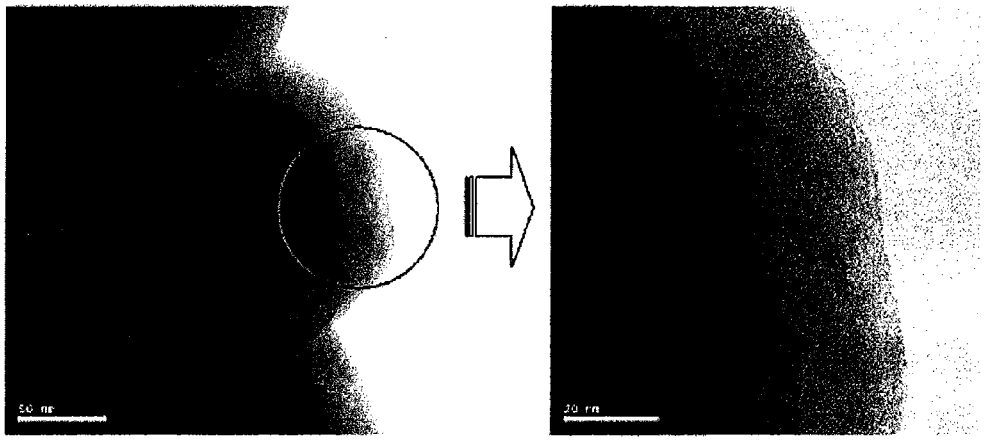
FIG. 6 illustrates a composite Ni particle prepared according to second Example, in which (a) is a TEM picture of the composite Ni particle, and (b) is a partially enlarged TEM picture of the composite Ni particle.

10 g of the organic Ni composite was loaded into a pyrex tube and sealed in $N_2$ or $H_2$ atmosphere. The sealed tube was loaded into an electric furnace and thermally treated at 450° C. for 1 hour to prepare silica-coated Ni composite particles. A result of TEM analysis on a prepared Ni composite particle is shown in FIGS. 6(*a*) (magnification of 200,000×) and 6(*b*) (magnification of 300,000×). As shown in FIGS. 5(*a*) and 5(*b*), a composite Ni particle was observed with silica uniformly coated on a Ni core. The Ni core of the Ni composite particle had a diameter of 100 nm to 150 nm and the silica coat had a thickness of about 20 nm.

Example 3

1 mole of nickel nitrate ($Ni(NO_3)_2$), by a volume of 500 ml, was added and solved into ethanol absolute, and 3-[2-(2-aminoethylamino)ethylamino]propyl-trimethoxysilane was added thereinto. Then, a resultant solution was stirred 1000 rpm at 25° C. for 10 mins. The temperature was raised to 75° C., which was maintained for 1 hour. After cooled down to a room temperature, the resultant solution was filtered by a 5 μm filter, cleaned three times with 100 ml ethanol absolute, and dried in a 50° C. oven for 4 hours, thereby producing an organic Ni composite.

10 g of the organic Ni composite was loaded into a pyrex tube and sealed in $N_2$ or $H_2$ atmosphere. The sealed tube was loaded into an electric furnace and thermally treated at 450° C. for 1 hour to prepare silica-coated Ni composite particles.

Example 4

Figure 7:
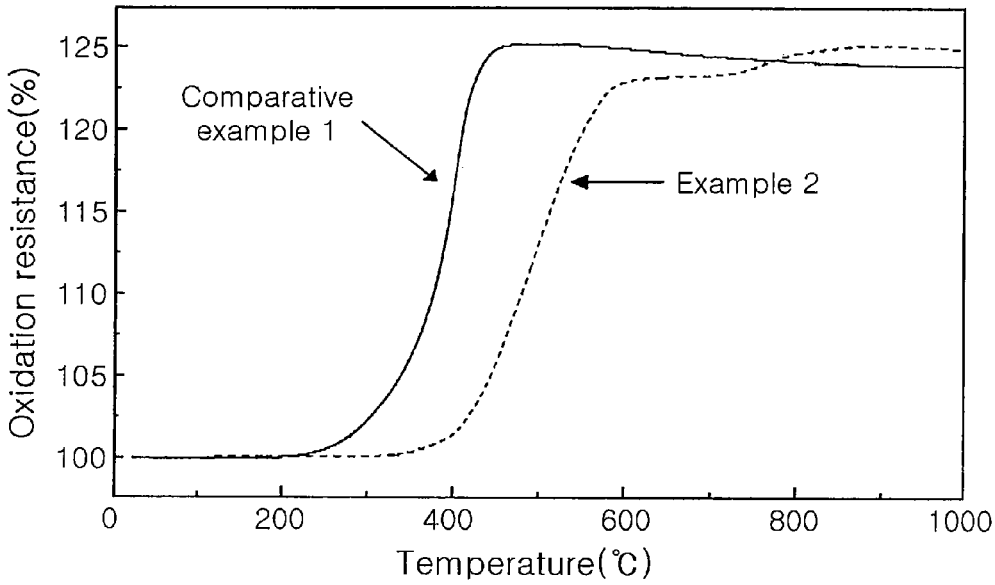
FIG. 7 is a graph illustrating a measurement result of oxidation resistance according to Example 4.

Example 4 is to prove that composite Ni particles of the invention are enhanced in oxidation resistance. In Example 4, oxidation resistance was analyzed by measuring, by differential thermo gravimetric analysis (TG), from composite Ni powder prepared in Example 2 and Ni metal powder (YH713 available from Sumitomo of Japan with a particle size of about 150 nm, hereinafter will be referred to as "Comparative Example 1"). Results are illustrated in FIG. 7.

The composite Ni powder prepared in Example 2 and the Ni metal power of Comparative Example 1 were loaded by 15 mg, respectively, into an alumina furnace of 5 mm diameter, arranged inside an equipment, and heated up to 1000° C. at a heating rate of 10° C./min in an air atmosphere (air 100 ml/min). During the heating, weight increases owing to oxidation were measured continuously. As a result, the composite Ni powder of Example 2 had a particle diameter similar to that of Comparative Example 1 but started oxidation in vicinity of 370° C. that is higher for about 100° C. over Comparative Example 1. These results confirmed improvement in oxidation resistant characteristics of the composite Ni powder of Example 2.

Example 5

Figure 8:
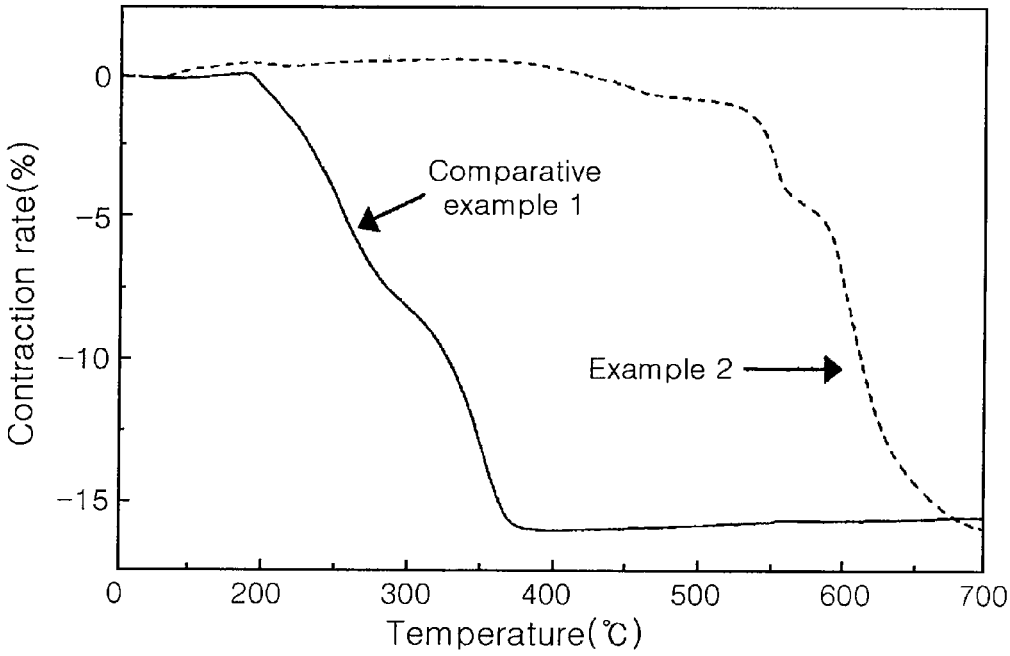
FIG. 8 is a graph illustrating a measurement result of contraction rate according to Example 5.

Example 5 is to prove that composite Ni particles of the invention are enhanced in shrink resistant characteristics. The Ni powders of Example 2 and Comparative Example 1 were measured of temperature dependent shrinkage and results are shown in FIG. 8. 0.3 g of the Ni powder of Example 2 and Comparative Example 1 were fabricated, by uniaxial press molding, into pellets having a diameter of 3.5 mm and a height of 2.5 mm. The pellets were placed inside a dilatometer and heated up to 1000° C. at a heating rate of 10° C./min in a reducing atmosphere ($N_2$+$H_2$ 100 ml/min). During the heating, weight increases owing to oxidation were measured continuously. In case of the Ni powder where silica is not coated (Comparative Example 1), rapid shrink took place at a temperature exceeding 200° C. and sintering was completed at a temperature on the order of 600° C. However, in case of the Ni powder coated with silica (Example 2), shrink took place slowly in vicinity of 600° C. and, in full-scale, in vicinity of 900° C. These results confirmed that the silica coating improved shrink resistant characteristics.

Composite Ni particles with a silica coat of the invention are improved in the oxidation resistance of Ni metal to prevent Ni oxide from diffusing or diffusing into a ceramic substrate in fabrication of an MLCC. The heat shrink starting temperature of Ni metal powder is migrated further to a higher temperature, showing a heat shrink characteristics similar to that of the ceramic substrate. Accordingly, in fabrication of a thin and compact MLCC composed of ceramic dielectric layers and internal electrodes, the composite Ni particles are adequate to be used a material for fabricating the internal electrodes of the MLCC, which can prevent delamination and cracks without damaging dielectric characteristics and electric properties. Furthermore, since oxides are not formed inside Ni particles, there is no worry that oxides may reside as impurities after the formation of the electrodes. The method of preparing composite Ni particles of the invention is environment friendly since it does not need additional solvent or additive. The method of the invention also can produce the composite Ni particles by thermally treating an organic Ni composite without having to use any complicated, expensive equipments. Thus, the method of the invention is economical in terms of time and cost. Furthermore, the thickness of the silica coat can be adjusted easily by controlling the type and reaction time of a silane coupling agent.

While the present invention has been described with reference to the particular illustrative embodiments and the accompanying drawings, it is not to be limited thereto but will be defined by the appended claims. It is to be appreciated that those skilled in the art can substitute, change or modify the embodiments into various forms without departing from the scope and spirit of the present invention.

What is claimed is:

1. A method of preparing nickel composite particles each comprising a nickel nano particle and a silica coat on the nickel nano particle, the method comprising steps of:

stirring and heating a mixture of a nickel salt solution and a precursor material of silica coat at a temperature ranging from 25° C. to 80° C. for 0.5 hours to 2 hours;

filtering, cleaning and drying a resultant product to obtain an organic nickel composite; and thermally treating the organic nickel composite at a temperature ranging from 200° C. to 500° C. for 0.5 hours to 4 hours, wherein the precursor material of the silica coat comprises a silane coupling agent containing a donor material for affording electrons to nickel ions and a silane group capable of forming silica by condensation.

2. The method according to claim 1, wherein the nickel salt is selected from the group consisting of $Ni(NO_3)_2$, $NiCl_2$, $NiSO_4$, and $(CH_3COO)_2Ni$.

3. The method according to claim 1, wherein the silane coupling agent comprises one selected from the group consisting of 3-aminopropyl trimethoxysilane (APTS), 3-(2-aminoethylamino)propyl trimethoxysilane, and 3-[2-(2-aminoethylamino)ethylamino]propyl-trimethoxysilane.

4. The method according to claim 1, wherein the thermal treatment is carried out in a nitrogen or hydrogen atmosphere.

5. The method according to claim 1, wherein the thermal treatment is carried out in one selected from the group consisting of a vacuum oven, an electric furnace, and a drier.

* * * * *